US006995712B2

(12) United States Patent
Boyanov

(10) Patent No.: US 6,995,712 B2
(45) Date of Patent: Feb. 7, 2006

(54) ANTENNA ELEMENT

(76) Inventor: Victor Boyanov, z.k.Liulin 5, bl.518, ent.B, ap.61, 1359 Sofia (BG)

( * ) Notice: Subject to any disclaimer, the term of this patent is extended or adjusted under 35 U.S.C. 154(b) by 0 days.

(21) Appl. No.: 10/498,668

(22) PCT Filed: Dec. 17, 2002

(86) PCT No.: PCT/BG02/00031

§ 371 (c)(1),
(2), (4) Date: Jun. 10, 2004

(87) PCT Pub. No.: WO03/052868

PCT Pub. Date: Jun. 26, 2003

(65) Prior Publication Data

US 2005/0057396 A1 Mar. 17, 2005

(30) Foreign Application Priority Data

Dec. 19, 2001 (BG) ..... 106243

(51) Int. Cl.
*H01Q 1/38* (2006.01)

(52) U.S. Cl. ..... 343/700 MS; 343/846

(58) Field of Classification Search ..... 343/700 MS, 343/846, 850, 848, 767, 770; H01Q 1/38
See application file for complete search history.

(56) References Cited

U.S. PATENT DOCUMENTS 4,903,033 A 2/1990 Tsao et al.
5,005,019 A 4/1991 Zaghloul et al.
5,043,738 A * 8/1991 Shapiro et al. ..... 343/700 MS
5,408,241 A * 4/1995 Shattuck et al. ..... 343/700 MS
6,018,320 A * 1/2000 Jidhage et al. ..... 343/700 MS
6,023,244 A * 2/2000 Snygg et al. ..... 343/700 MS

FOREIGN PATENT DOCUMENTS

SE WO 99 31757 A 6/1999

OTHER PUBLICATIONS

Wong K-L et al: "Broad-Band Single-Patch Circularly Plarized Microstrip Antenna withdual Capacitively Coupled Feeds" IEEE Transactions on Antenna and Propagation, IEEE Inc. New York, US, vol. 49, No. 1, Jan. 2001, pp. 41-44, xp001058724 ISSN: 0018-926X.

* cited by examiner

*Primary Examiner*—Hoanganh Le

(74) *Attorney, Agent, or Firm*—Nexsen Pruet Adams Kleemeier, LLC; Michael A Mann

(57) ABSTRACT

The antenna element comprises: an electrically conductive ground plane (2) on which two orthogonal symmetrically crossing slots (3) are formed; a radiating patch (1) supported in a spaced relationship on the one side of the said ground plane; conductive feeding tracks (4) supported on the other side of the said ground plane and electromagnetically coupled with the slots (3). One of the ends of each feeding track (4) is input/output port (5) of the antenna element and the other end is disposed after the slot (3), so as the feeding tracks (4) to cross the slots (3). A compensating capacitive element (6) couples the ends of the feeding tracks (4) laid after the slots (3).

14 Claims, 4 Drawing Sheets

ANTENNA ELEMENT

This application is the national phase under 35 U.S.C.§371 of PCT International Application No. PCT/BG02/00031 which has an International filing date of Dec. 17, 2002 which designated United States of America.

TECHNICAL FIELD

The present invention relates to an antenna element for use in electromagnetic radiation antenna structures capable for receiving and transmitting radio signals that may include dual orthogonal polarized components, especially for use in antenna arrays.

PRIOR ART

The identified patch antenna elements comprise radiating patch having the appropriate shape and size and placed above a ground plane or dielectric substrate or spacing element. The patch provides the essential electrical and radiating properties. In this case the exciting signals pass trough slots arranged to cross each other orthogonally in their centers. Each slot excites corresponding mode within the antenna element. The slots are fed through feed tracks that may generally form any type of transmition line that is suitable for the respective structure of the antenna element. The point of excitation where the feed tracks cross the corresponding slot lays on one of its arms.

Slot fed antenna elements have the drawback of non-optimal feeding the slot aside it center, having the field along the slot deformed and decreased impedance toward the slot ends narrowing the bandwidth. Another drawback caused from slots crossing is the mutual influence between said slots and respective ports, what directly deteriorate the polarization properties of the antenna element. This effect is much stronger when asymmetrical slot feeding is applied.

Such antenna elements are previously known, e.g., U.S. Pat. No 6,018,319 (Lindmark). In this known solution a special feed track arrangement is provided reducing the coupling between the slots. Drawback of this antenna element is the different way of the slots excitation, which leads to different impedance behavior of the antenna ports. The excitation efficiency and respective field amplitudes are different, what deteriorates the polarization properties especially for circular polarization.

SUMMARY OF THE INVENTION

The object of the present invention is to provide a simpler and less expensive dual polarized antenna element with good polarization properties in wider frequency band bandwidth.

According to the invention, these objectives are achieved with antenna element including ground plane element comprising two orthogonal symmetrically crossed slots, a conductive patch element disposed above and in a predetermined space relationship with the said ground plane element and the said slots, two substantially identical feed track arrangements disposed below the said ground plane element and electromagnetically coupled to said slots, having on one of the ends thereof input/output port of the antenna element and the opposite ends thereof disposed after the crossing point with the said slots in such a way, so as the feed track to pass under the corresponding slot, characterized in that the said opposite ends of the feed tracks are coupled with a compensative capacitive element.

In a preferred embodiment the said capacitive element is a microstrip capacitor.

In another embodiment the said capacitive element is a lumped element.

It is expedient the said feed tracks to comprise impedance matching elements.

It is suitable the part of the said feed tracks disposed right after the slots to function as impedance matching element.

The said feed tracks, preferably in form of microstrip lines, could be arranged as symmetrical or asymmetrical strip lines or other type of planar transmition lines.

In one variant of implementation of the antenna element between the said patch and the said slots is placed dielectric material filling at least partially the space in between.

In other variant of implementation of the antenna element between the said slots and the said feed tracks is placed dielectric material filling at least partially the space in between.

It is expedient the said ground plane element said feed tracks and said patch to be arranged as printed circuit board layers.

It is preferable the said patch to have radially symmetrical shape in respect to said slots.

In a preferred embodiment the antenna element comprises more than one of said patch stacked above the said ground plane.

In other preferred embodiment the antenna element the said patch is disposed in a cavity formed of conductive walls surrounding the said patch.

In this embodiment is expedient the cavity to be filled at least partially with dielectric material.

Advantages of the antenna element according to the invention are the simpler from technological point of view structure, simpler and less expensive construction. The antenna element has reduced inductive mutual coupling between the two symmetrical parts of the structure hence two main properties of the element are improved:

The cross polarization component of the radiated field is reduced significantly;

Better impedance matching due to compensated reactive part of the impedance of the input ports is achieved that betters the bandwidth in respect to VSWR.

Another advantage is the opportunity to compensate the increased inductive mutual influence caused from moving the crossing point of the slots and feed tracks closer to the slots center whereby the amplitude distribution of the field along the slot is improved. As result more symmetrical radiation pattern could be formed.

BRIEF DESCRIPTION OF THE INVENTION

DETAILED DESCRIPTION OF THE PREFERRED EMBODIMENTS

Figure 1:
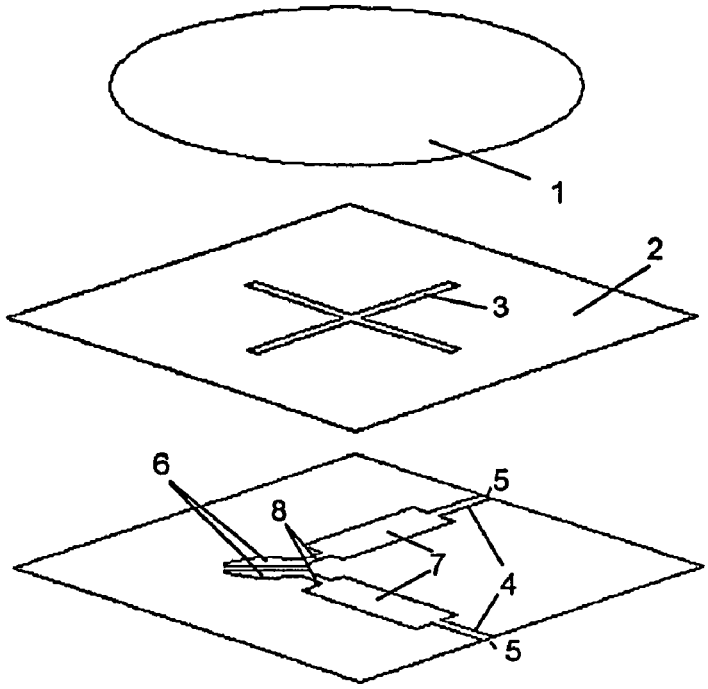
FIG. 1 shows an exploded view of the antenna element according to the invention.
Figure 2:
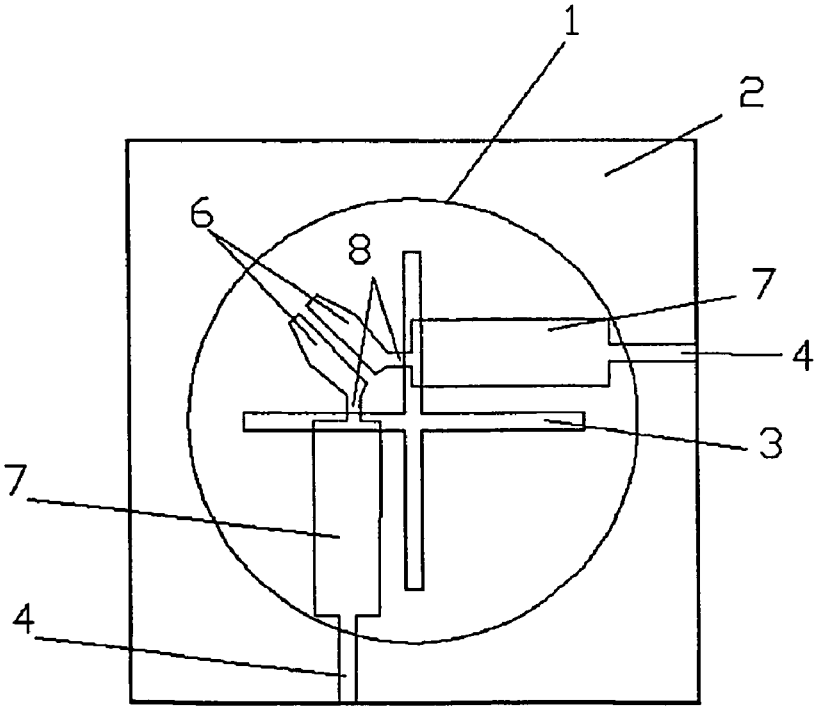
FIG. 2 shows a top view of the antenna element according to the invention.

Referring to FIG. 1–2, the antenna element comprises radiating patch 1 with providing the expected electrical performance arbitrary shape, but preferably circular from antenna array populating point of view, a ground plane 2 disposed under the radiating patch and comprising two slot apertures arrangements 3 crossing each to other orthogonally in their centers, feed tracks 4 disposed under the ground plane 2 so to cross one of the arms of the corresponding slot 3 laying above. The feed tracks could be symmetrical or asymmetrical strip lines. The preferred slot length is less a half effective wavelength (of the electromagnetic field). Each feed track 4 is disposed in certain way corresponding to the slot influence over the transmition line parameters. The first end of the feed tracks 4 is connected to a input/output port 5 of the antenna element, whereas the second end, placed after the crossing point of the track 4 with the slot 3, is connected to the corresponding end of the other feed track trough capacitance 6.

The antenna element comprises impedance matching circuit 7 that (expediently) could be quarter wavelength transformer.

An impedance matching stub 8, as a part of the feed track 4 and disposed immediately under the slot 3 could be arranged.

Figure 3:
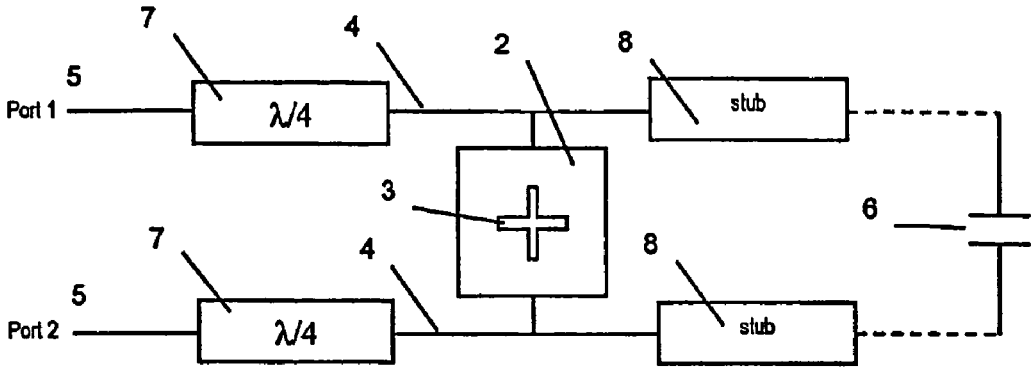
FIG. 3 shows an electrical block diagram of the antenna element.

Referring to FIG. 3 an electrical block diagram of the structure described above is shown. The parallel connection of the compensative capacitive element 6 ensuring the aimed effects can be seen.

Figure 4:
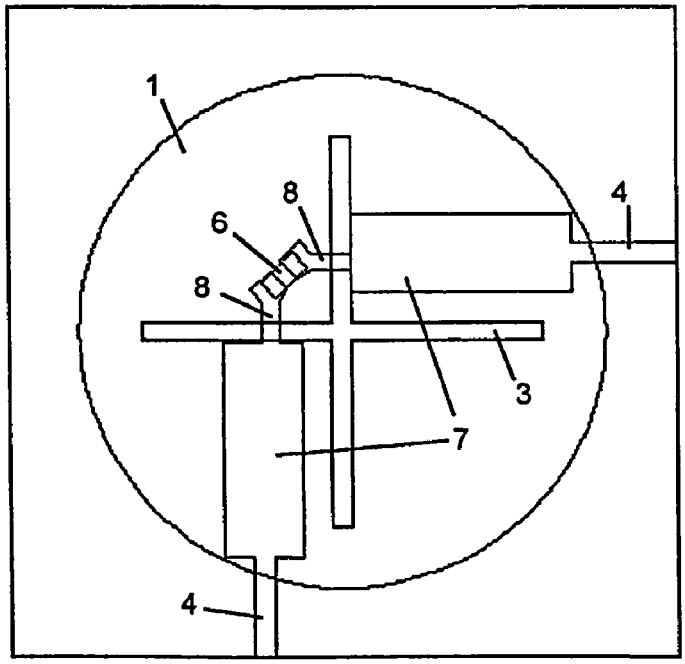
FIG. 4 shows a top view of a preferred embodiment of the antenna element according to the invention.

The preferred embodiment of the antenna element shown on FIG. 4 is with lumped element capacitance 6, particularly in form of SMD capacitor.

Figure 5:
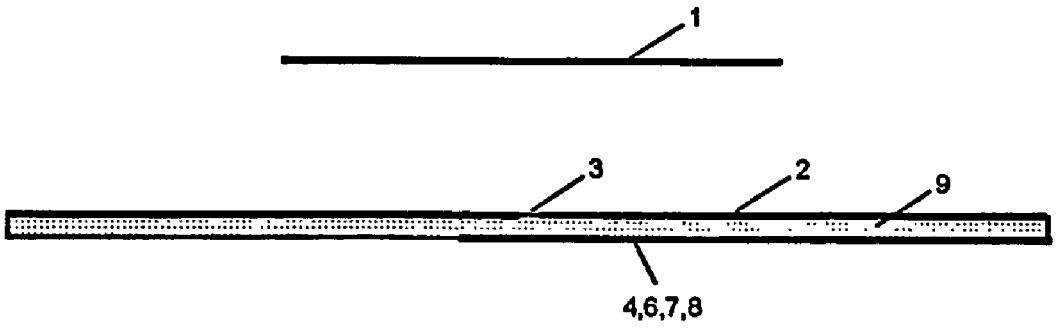
FIG. 5 shows a side view of a preferred embodiment of the antenna element with disposed between the slots and the feed tracks dielectric material.

The embodiment, referring to FIG. 5, provides two feed structures comprising the feed tracks 4, the compensative capacitive element 6, the impedance matching elements 7 and the stubs 8, whereas between these structures and the ground plane element 2 is placed dielectric material 9. The dielectric material 9 fills partially or entirely the space between the ground plane 2 and the feed structures.

Figure 6:
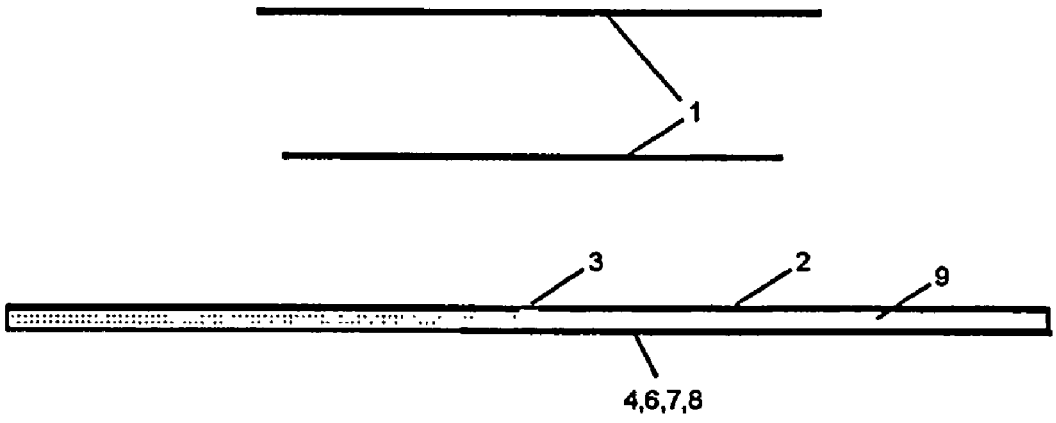
FIG. 6 shows a side view of an antenna element with two radiating patches and disposed between the slots and the fed tracks dielectric material.
Figure 7:
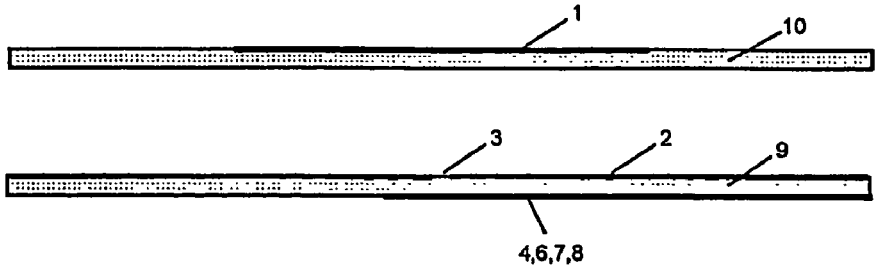
FIG. 7 shows a preferred embodiment of the antenna element with disposed between the radiating patch and the slots and second dielectric material disposed between the slots and the feed tracks.

Referring to FIG. 6 a further embodiment of the element comprises second radiating patch 1 and referring to FIG. 7 comprises second dielectric material 10, disposed between the radiating patch 1 and the ground plane element 2.

Figure 8:
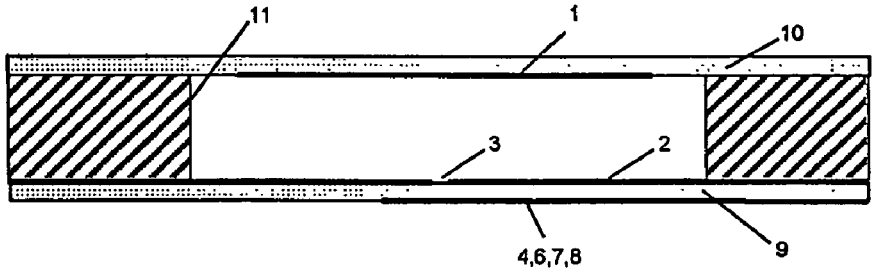
FIG. 8 shows a preferred embodiment of the antenna element with radiating patch placed in a cavity.
Figure 9:
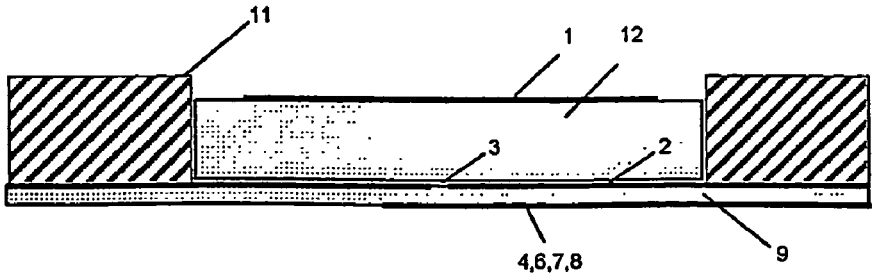
FIG. 9 shows the embodiment of FIG. 8 with dielectric material filled cavity.

Referring to FIG. 8–9 other preferred embodiment comprises radiating patch 1 disposed in a cavity 11 formed from conductive walls completely surrounding the patch 1. Referring to FIG. 9 the cavity 11 could be filled with dielectric material 12.

Referring to FIG. 6 other preferred embodiment comprises stacked radiating patches 1, dielectric materials 9, 10 and 12 particularly in single or multi layer accomplishment.

The antenna element of the present invention is applicable in cases when dual polarization or polarization switching is needed. Particularly it can be implemented in phased array antennas with polarization control implementation. The antenna element is applicable either for linearly or circularly polarized antennas. Basic requirement to the element is to be arranged with two separate input/output ports 5 for both polarizations that directly provide linear polarization and with suitable combining (implementing 90 deg. phase shift between the ports 5) circular one could be realized.

The antenna element acts as follows:

The crossing of the feeding tracks 4 with the slot 3 is equivalent to loading the transmission line 4 with predetermined load, having inductive impedance due to the shorter than resonant length slots 3. The impedance matching stub 8 compensates this reactive part of the load in order to achieve purely active load. Afterwards the load impedance is matched to the impedance of the feed track trough the matching element 7, particularly in the form of quarter wavelength transformer.

Basically there are two components form the input impedance of two port antenna elements, the first and more significant is the self-impedance of the port and the second is the mutual impedance between the ports. To achieve good polarization properties the two modes of the field distribution should be purely orthogonal and linear, what is strongly influenced by the inductive slot mutual coupling. From electromagnetic point of view the mentioned influence is expressed as certain bending of the electric field in the slots 3 causing in the crossing point the field to have tangential component perpendicular to the other slot and easy to propagates in it. In this way a certain amount of energy from one of the ports 5 passes to the other. Regarded as transmission lines parameters this coupling has inductive character and could be compensated with capacitive element 6 connected in parallel to the slots 3 (see FIG. 3). The capacitive element 6 could be arranged in different ways according to the used antenna element technology. For instance it could be a microstrip capacitance or SMD capacitor.

What is claimed is:

1. An antenna element comprising: a ground plane having two substantially identical slots being disposed at right angles to each other and symmetrically crossing in respective midpoints thereof, a radiating patch disposed in a predetermined spaced relationship with and above the said ground plane, conductive feed tracks disposed below the said ground plane, having electromagnetical coupling with the said slots, each of said feed tracks having on one end thereof an input/output port of the antenna element and the opposite end thereof disposed after the said slots, so as the feed tracks pass under the corresponding one of said slots, characterized in that the said opposite ends of the said feed tracks are coupled by a compensative capacitive element.

2. Antenna element as claimed in claim 1, characterized in that the said compensative capacitive element (6) is a microstrip capacitor.

3. Antenna element as claimed in claim 1, characterized in that the said compensative capacitive element (6) is a lumped element.

4. Antenna element as claimed in claim 1, 2 or 3, characterized in that the said feed tracks (4) comprise impedance matching elements (7).

5. Antenna element as claimed in claim 1, characterized in that the part (8) of the said feed tracks (4) disposed proximately to each of said slots (3), has impedance matching properties.

6. Antenna element as claimed in claim 1, characterized in that the said feed tracks (4) are microstrip lines.

7. Antenna element as claimed in claim 1, characterized in that the said feed tracks (4) are symmetrical or asymmetrical strip line.

8. Antenna element as claimed in claim 1, characterized in that a dielectric material (10) is disposed between said patch (1) and said slots (3) filing at least partially the space in-between.

9. Antenna element as claimed in claim 1, characterized in that a dielectric material (9) is disposed between said ground plane (2) and said feed tracks (4) filing at least partially the space in-between.

10. Antenna element as claimed in claim 1, characterized in that the said ground plane (2), said slots (3) and said feed tracks (4) are printed circuit boards' layers.

11. Antenna element as claimed in claim 1, characterized in that the said patch (1) substantially has radially symmetric shape in respect to said slots (3).

12. Antenna element as claimed in claim 1, comprising one or more patches stacked above said patch (1).

13. Antenna element as claimed in claim 1, characterized in that the said patch (1) is disposed in a cavity (11) formed of conductive walls surrounding the said patch (1).

14. Antenna element as claimed in claim 13, characterized in that dielectric material (12) is disposed in the said cavity (11) filing at least partially the space inside thereof.

* * * * *